US006702277B1

(12) United States Patent
Gaffal

(10) Patent No.: US 6,702,277 B1
(45) Date of Patent: Mar. 9, 2004

(54) DELIVERY DEVICE FOR THE SECTIONS OF A STRIP OF FILM

(75) Inventor: Peter Gaffal, Rudersberg (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/807,875

(22) PCT Filed: Sep. 17, 1999

(86) PCT No.: PCT/EP99/06891

§ 371 (c)(1),
(2), (4) Date: May 18, 2001

(87) PCT Pub. No.: WO00/23368

PCT Pub. Date: Apr. 27, 2000

(30) Foreign Application Priority Data

Oct. 19, 1998 (DE) ..... 198 47 923

(51) Int. Cl.[7] ..... B65H 29/32

(52) U.S. Cl. ..... 271/196; 271/5; 271/11; 271/94; 271/96; 271/108

(58) Field of Search ..... 271/5, 11, 94, 271/96, 108, 196; 414/27

(56) References Cited

U.S. PATENT DOCUMENTS 1,706,952 A * 3/1929 Broadmeyer ..... 271/96
3,633,731 A 1/1972 Jones
3,894,636 A 7/1975 Tonus
3,921,827 A * 11/1975 Joice ..... 414/793
5,143,367 A 9/1992 Potorff
6,112,778 A * 9/2000 Nish et al. ..... 141/6

FOREIGN PATENT DOCUMENTS

GB 1 434 395 5/1976

* cited by examiner

*Primary Examiner*—Eileen D. Lillis
*Assistant Examiner*—Michael Lowe
(74) *Attorney, Agent, or Firm*—Herbert Dubno

(57) ABSTRACT

The invention relates to a delivery device for the sections of a strip of film that are fed in a direction of conveyance, especially in a bead welding machine, comprising a rotor (40) that is driven and rotated around an axis (40) lying parallel thereto on the plane of conveyance with several contact areas that extend radially towards the axis of rotation (40) and which grasp successively fed strip sections in an operational mode, deflect said strip sections from the plane of conveyance and deliver them to a delivery station, whereby each respective contact area (10) of the rotor comprises suction areas (12) that can be subjected to an underpressure to hold said strip sections on the contact areas (10) when the contact areas (10) of the rotor move through the segment of a circle (14) between a first and a second position of rotation (16 or 18). In order to achieve trouble-free delivery of said strip sections, the angle of the circle segment (14) can be adjusted within limits.

7 Claims, 6 Drawing Sheets

DELIVERY DEVICE FOR THE SECTIONS OF A STRIP OF FILM

CROSS REFERENCE TO RELATED APPLICATIONS

This application is a national stage of PCT/EP99/06891 filed Sep. 17, 1999 and based upon German national application 19847923.9 filed Oct. 19, 1998 under the International Convention.

FIELD OF THE INVENTION

The invention relates to a delivery device for segments of a web fed in a feed direction and composed of film, for example bags, especially in a separating-seam welding machine. Such a machine can have a rotatably driven rotor whose axis lies in the feed plane or parallel thereto and can be equipped with a plurality of contact regions extending radially with respect to the rotation axis, whereby in operation the web sections fed so as to follow one another are gripped, swung out of the feed plane and deposited one above the other at a deposition station. The respective contact region of the rotor can encompasses suction regions which serve to hold the web section on the contact region with an underpressure when the contact region of the rotor travels over a circular segment between a first and a second angular position.

BACKGROUND OF THE INVENTION

Such a delivery device is known. It comprises a rotor with bar-shaped gripper arms which extend radially and form the respective contact regions. Each gripper arm of the rotor with a respective pressure communication opening sweeps across an opening delivering underpressure (suction) in a part which is stationary in operation, the suction supply opening extending over the aforedescribed circular segment. When the respective pressure communication opening sweeps across the suction supply opening, underpressure (subatmospheric pressure) is applied to the suction openings of the contact regions of the gripper arm.

Depending upon the surface characteristics of the web section to be picked up and delivered, it is desirable to maintain an underpressure at the suction region either for as long as possible and thus until the delivery station is just reached or only up to a certain point in time before reaching the delivery station. The smoother the surface of the web segment, the smaller is the friction with which the respective web segment rests against the contact region of the gripper arm and thus the longer should the underpressure remain applied to the respective gripper arm so that the smooth web section does not slip. The rougher the surface of the material web the higher is the friction and thus the better is the adhesion of the material web of the contact region of the gripper arm. As a consequence it is advantageous in these cases to remove the suction from the suction region even before the delivery station is reached so as to prevent the plastic bag for example, which must be deposited on two spike-like projections, from tearing in the region of the spike-like projections because of excessive adhesion or even from separating at weakening lines which may be provided.

After an interruption in operation and thus the bringing of the manufacturing process for the web sections to standstill, a stationary part of the conventional apparatus which has an opening supplying the suction and extending in the peripheral direction, may be rotated which can cause the suction region of a gripper arm in the respective circular segment to be subjected to suction prematurely or too late. In the case of a premature elimination of the underpressure, in the first rotation the underpressure may be applied before the gripper arm comes into contact with the web section. This means that the suction region of the gripper arm is already subjected to underpressure at a point in time in which it has not yet come into contact with a web section to be picked up and to be swung away. The volume rate of flow of air in the rotor is then excessive and results in a reduction of the suction within the rotor. Web sections tend to adhere less well to the contact region of the gripper arm. Problems result because there is an insufficient resistance to the air flow by the web sections in the operation of the device. The web sections can slip on the contact regions of the gripper arm and the operation of the delivery device is defective. The down time of the machine which is provided with the delivery device increases.

OBJECT OF THE INVENTION

The object of the present invention is to improve a delivery device of the type described at the outset so that suction control is possible during the delivery of the web section and simultaneously the danger which arises in operation of the machine is not increased, i.e. a reliable securing of the web section to the contact region of the rotor is ensured.

SUMMARY OF THE INVENTION

This object is achieved with a delivery device of the type mentioned according to the invention in that the angle of the circular segment, within which the suction region of the contact region is subject to suction pressure is adjustable within limits.

In the delivery device of the invention it is also possible after adjustment or adjustable setting of the first angular position, preferably such that suction is applied to the suction region exactly at the point in time in which the contact region comes into contact with the web section, the second angular position can be adjusted corresponding to the surface characteristics of the web section. Thus according to the invention there is not a fixed circular segment angle which can be rotated as such in the rotation direction or counter to the rotation direction, but a variation in the size of the circular segment and thus the size or the circumferential length of this region over which suction remains applied to the suction region. It has been found to be advantageous and satisfactory when the first angular position is not adjustable and the second angular position is provided so as to be adjustable. In this manner, the first angular position can be set so that the time point of underpressure application coincides with the time point at which the contact region of the rotor contacts the web section. The disadvantage of the known device, that too great a volume flow takes place via the suction region into the interior of the rotor and the underpressure remaining there drops, can be avoided.

According to the present invention, respective separately controllable spaces can follow one another for example in the rotation direction and in which respective underpressures are generated and can be swept by the respective pressure communication openings of respective contact regions of the rotor. The size and therefore the angle of the circular segment in which an underpressure application to the suction region of the rotor arises can be achieved by a corresponding adjustment or nonadjustment of the openings.

A preferred embodiment of the invention is characterized in that a mouth opening of a passage connected to the suction region of a respective contact region and rotating with the contact region is provided in the region within the circular segments with one or more openings extending in the rotation direction or arranged in the rotation direction and communicating with the contact regions while between the mouth opening of the passage and the suction supplying opening at least one control element defining a control opening is provided which is rotatable relative to the rotor. According to this inventive concept, the size of the angle and thus the angular extent or length of the circular segment within which there is application of suction to the respective suction region is varied by the setting element and such that at least one control opening in the setting element extends or shortens the suction feed opening in the circumferential direction.

From a point of view of manufacture, it has been found to be advantageous for the underpressure feed opening to be formed by a part which is stationary relative to a machine frame in operation. In this manner it is possible to exactly define the first angular position relative to the feed plane of the material web sections. Furthermore, any optional passage means, which need not be flexible can be used for pressure communication between the underpressure feed opening and device for generating the underpressure.

The aforementioned stationary part can form a hub through which a drive train for the rotor can extend.

According to a further preferred embodiment, the stationary part, especially the hub, bounds the compartment feeding the suction and extending in the peripheral direction and which opens via the suction supply opening in a sealing surface against which the setting element lies slidingly with its control opening. The suction supply chamber provides a sufficient suction capacity. As a consequence of the fact that the suction supply chamber is formed directly in the stationary part, it is possible without further passage means between them to have the suction chamber open directly via the suction supply opening in the sealing surface so that the greatest possible flow cross section is available and such that only the size of the mouth opening of the respective duct means of the contact region is limiting.

While the sealing surface does not necessarily have to be planar to be useful (it can also have a cone shape), it has been found to be advantageous for the setting element to be disk-shaped or flange-shaped and to be rotatable relative to the suction supply opening about the rotation axis. The system thus does not deal with a linearly shiftable slide or shifting element but rather the setting element is rotatable about the same axis is as the rotor with respect to which the suction supply opening is bounded.

The setting element is, in a further feature of the invention, advantageously rotatably limited by a stop element. In an especially advantageous further feature of this inventive concept, the stop element is formed by a projection projecting over the sealing surface into a recess of the setting element.

According to still a further inventive concept, the projection bounds the suction supply opening on one side in the peripheral direction and engages as sealing cams in a control opening of the setting element. The projection serves thus at the same time as a stop element and as the means defining the first angular position independently of the instantaneous setting of the setting element.

When the delivery device is to reliably release the web section from the contact region following the underpressure application to the contact region, an overpressure application to the contact region should be effective and thus it is especially advantageous for there to be an overpressure energized section following the control opening of the setting element in the direction of rotation of the rotor which is swept over in operation by the mouth opening of the duct means. The invention in a further feature proposes that the section to which overpressure is applied be formed within the setting element. It can, in this case, be formed by a radial and axial opening communicating a compressed air connection.

It has been found to be advantageous further for the setting element to be rotatably driven with respect to the underpressure feed opening by a motor, which can be pneumatic or hydraulic, or driven in some other way. For this purpose, the setting element can have on its outer periphery coupling means, for example in the form of teeth, an articulation for a reciprocating rod or the like. It is however also possible to provide internal teeth on an appropriate section of the setting element which can mesh with a pinion as long as that section is radially outwardly of the drive train for the rotor.

BRIEF DESCRIPTION OF THE DRAWING

Further features, details and advantages of the invention are given with reference to the illustrations and the subsequent description of a preferred embodiment of a delivery device according to the invention which has been shown only fragmentarily in the drawing. In the drawing.

SPECIFIC DESCRIPTION

Figure 1:
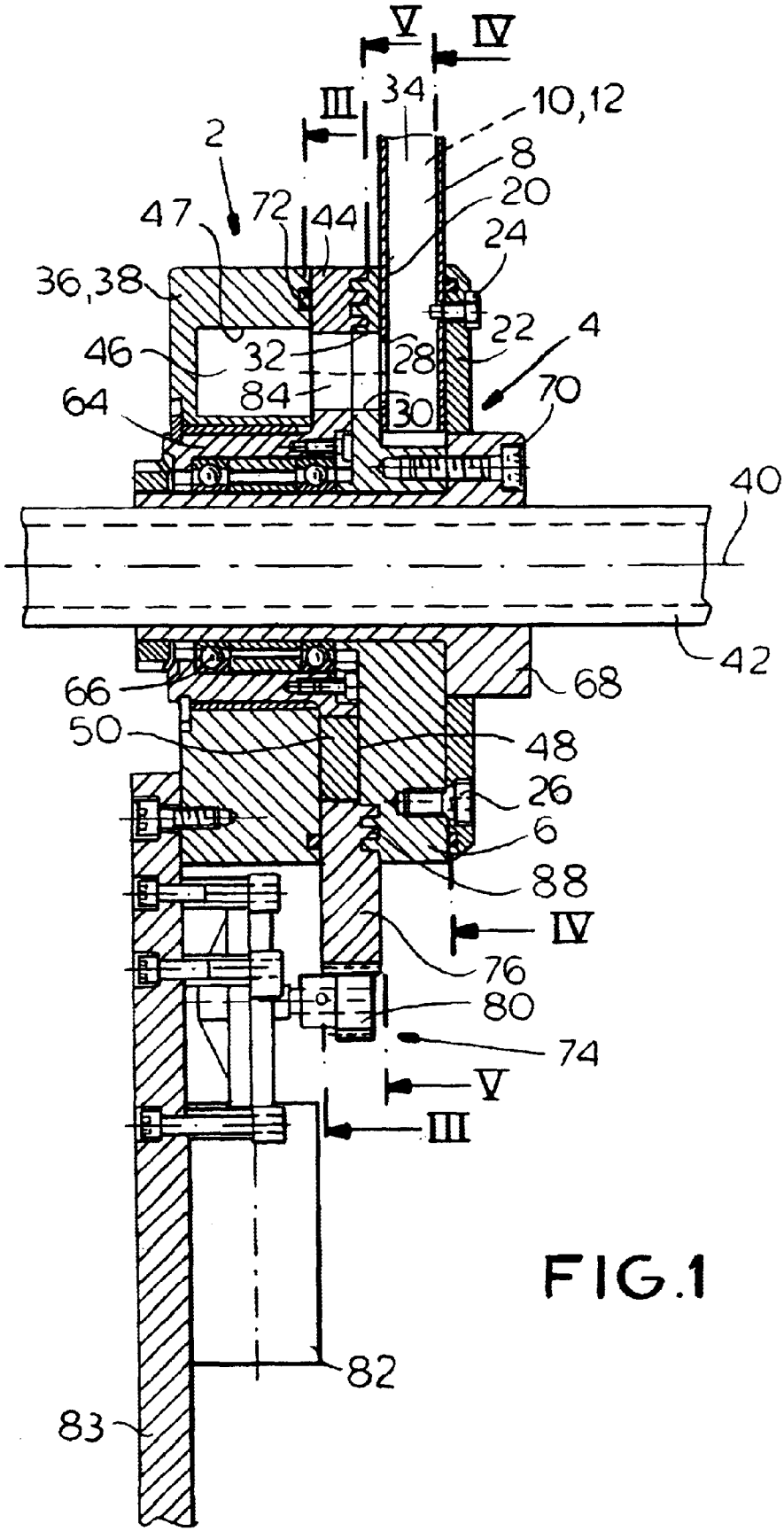
FIG. 1 shows a sectional view through a rotor region of a delivery device according to the invention for web segments.
Figure 2:
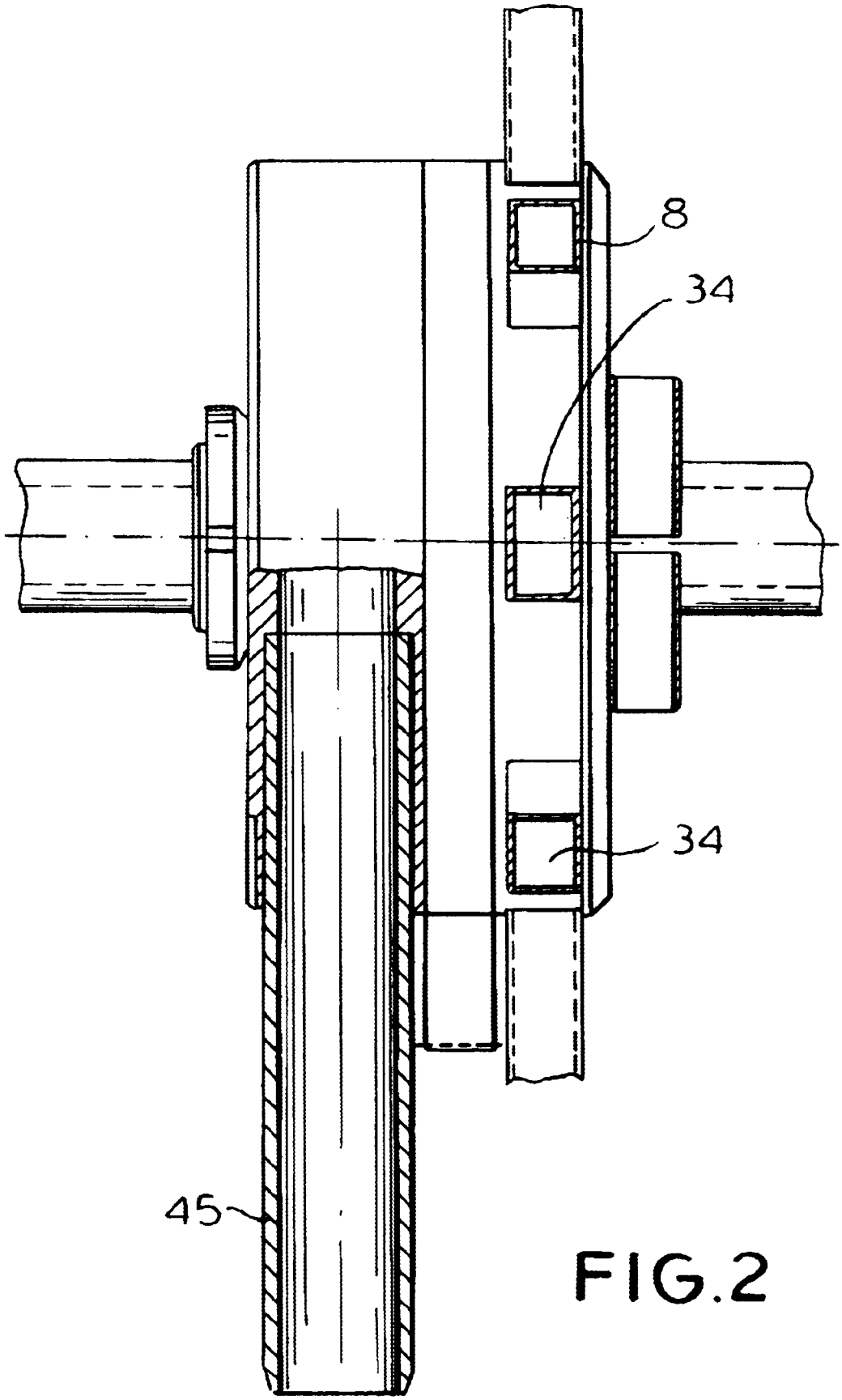
FIG. 2 shows a partly broken away elevational view of the rotor region of FIG. 1.

FIGS. 1 and 2 are views of the rotor region 2 of a delivery device for a separating-seam welding machine for producing bags from film which are stacked upon one another at the delivery station and are thereby accumulated on mandrel-shaped projections. The rotor 4 of the delivery device encompasses a plurality of gripper arms extending radially to a rotor disk 6. The gripper arms 8 of rotor 4 pass through a pickup station to which the web segments are fed in succession. In passing through the pickup station, the gripper arms 8 of rotor 4 engage below respective web segments to lift them out of the pickup station and carry them into the previously described delivery station.

The gripper arms 8 of the rotor 4 are configured as bar-shaped hollow bodies.

Figure 4:
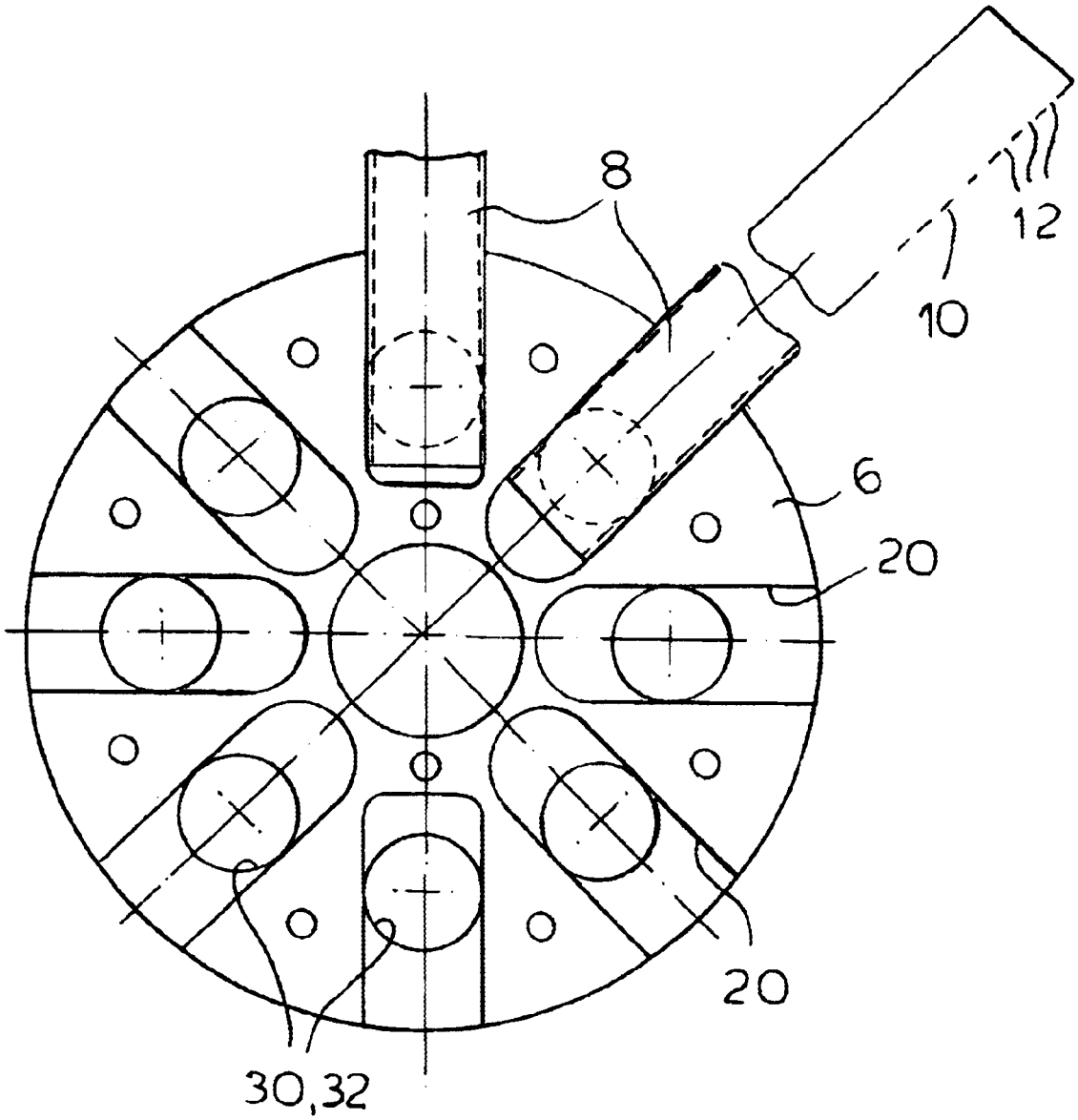
FIG. 4 is a plan view of the rotor seen in the direction of the arrows IV—IV in FIG. 1.

As has been indicated in FIG. 4, the gripper arms 8 have a contact region 10 with which they can lie against the web segments to be handled. The arms also have suction regions 12 which are located within a circular segment region 14 (see FIG. 6) between a first angular position 16 and a second angular position 18 of the respective gripper arms 8 and within which suction is applied thereto.

Gripper arms 8 are fitted into respective radially directed correspondingly shaped openings 20 (FIG. 1) in the rotor disk 6 at the right-hand end and are secured by means of an axial cover 22 and an axial securing means 24 both in the axial direction and in the radial direction against release from the rotor disk 6. The cover 22 is bolted to the rotor disk 6 as represented at 26.

Each gripper arm 8 has an axial opening 28 which, within the shaped recess 20 registers with an axial opening 30 in the rotor disk 6. The axial opening 30 forms a mouth opening 32 of the rotor 4. The hollow gripper arm 8 forms a duct 34 between the mouth opening 32 and the suction openings 12 of a respective contact region 10.

The rotor 4 is journaled with its rotor disk 6 relative to a stationary part 36 forming a hub 38 (FIG. 3) for the rotation about a rotation axis 40 about which it is driven by a drive shaft 42. Between the rotor disk 6 and the hub 38 is a positioning and setting device 44 to be described further and which has been illustrated in detail in FIG. 5.

Figure 3:
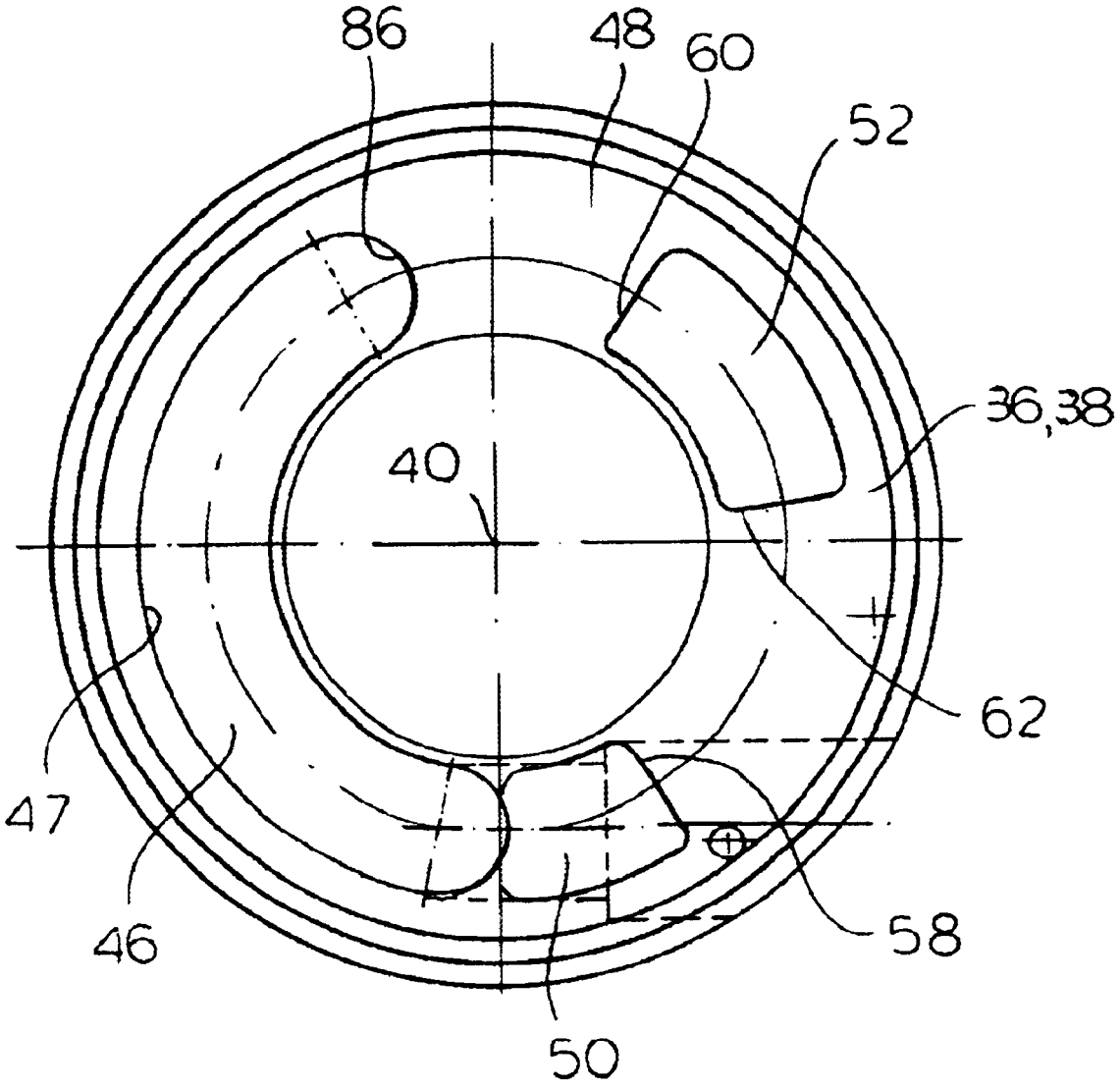
FIG. 3 is an elevational view of a stationary hub seen in the direction of the arrows III—III in FIG. 1.

The hub 38 has, as can be seen from FIGS. 1 and 3, a chamber 46 extending in the rotation direction concentrically to the rotation axis 40 and which is connectable with a device for producing suction and which has not been shown, via a suction duct 45 (FIG. 2, not shown in FIG. 3). The chamber 46 is in the form of a recess worked into the hub forming part 38 of member 36. This recess is bounded, toward the setting member 44, by an opening 47 delivering the underpressure. The axial region of part 36 surrounding the underpressure-delivering opening 47 forms a sealing surface 48 against which the axial side of the setting device 44 lies in a substantially sealing manner. From the sealing surface 48, projections 50 and 52 protrude, the projection 50 limiting the space 46 in the peripheral direction, the projection 52 is set back from the other peripheral end of the chamber 46 in the peripheral direction.

Figure 5:
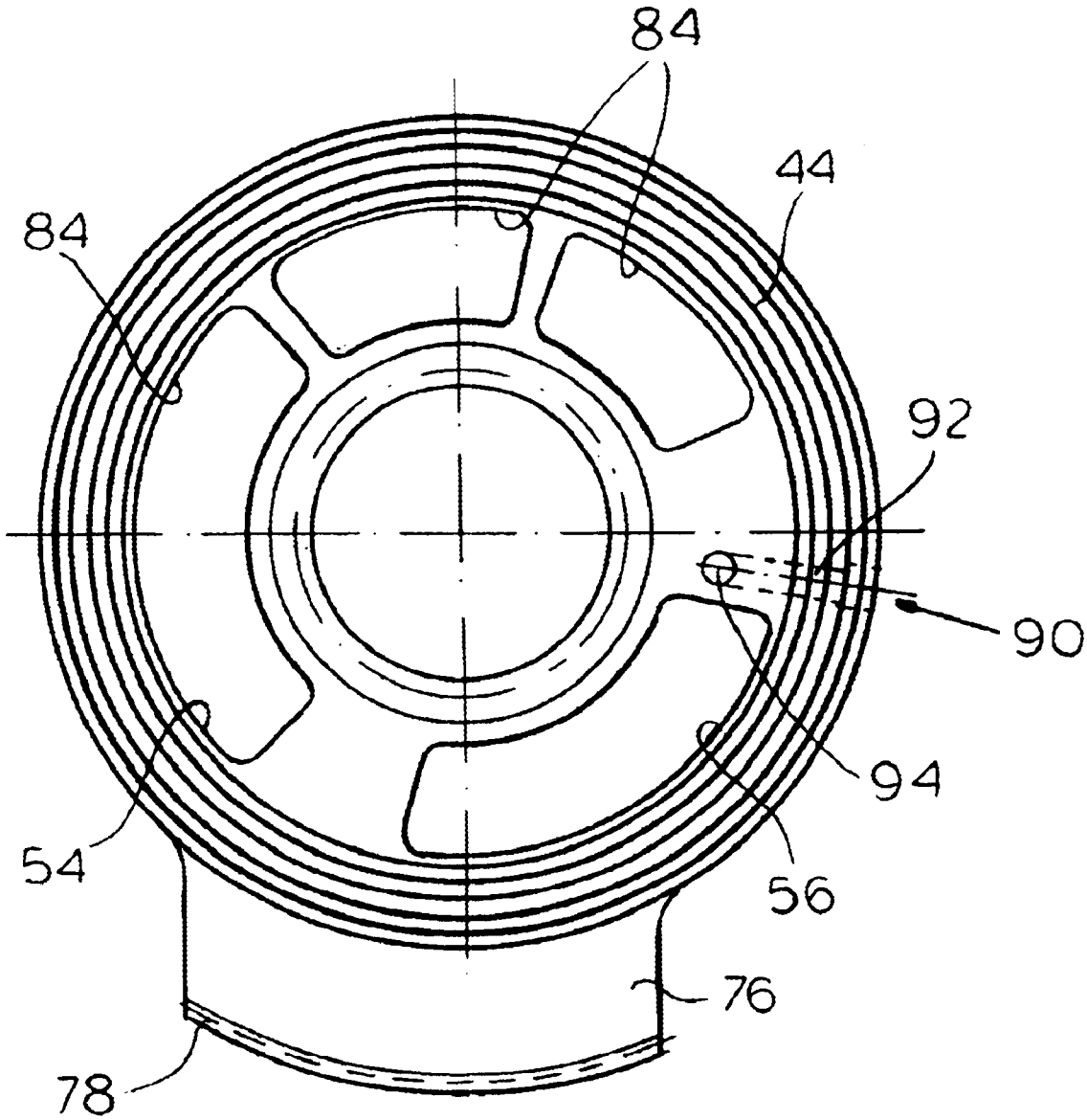
FIG. 5 is a plan view of a setting element seen in the direction of the arrow V—V in FIG. 1.
Figure 6:
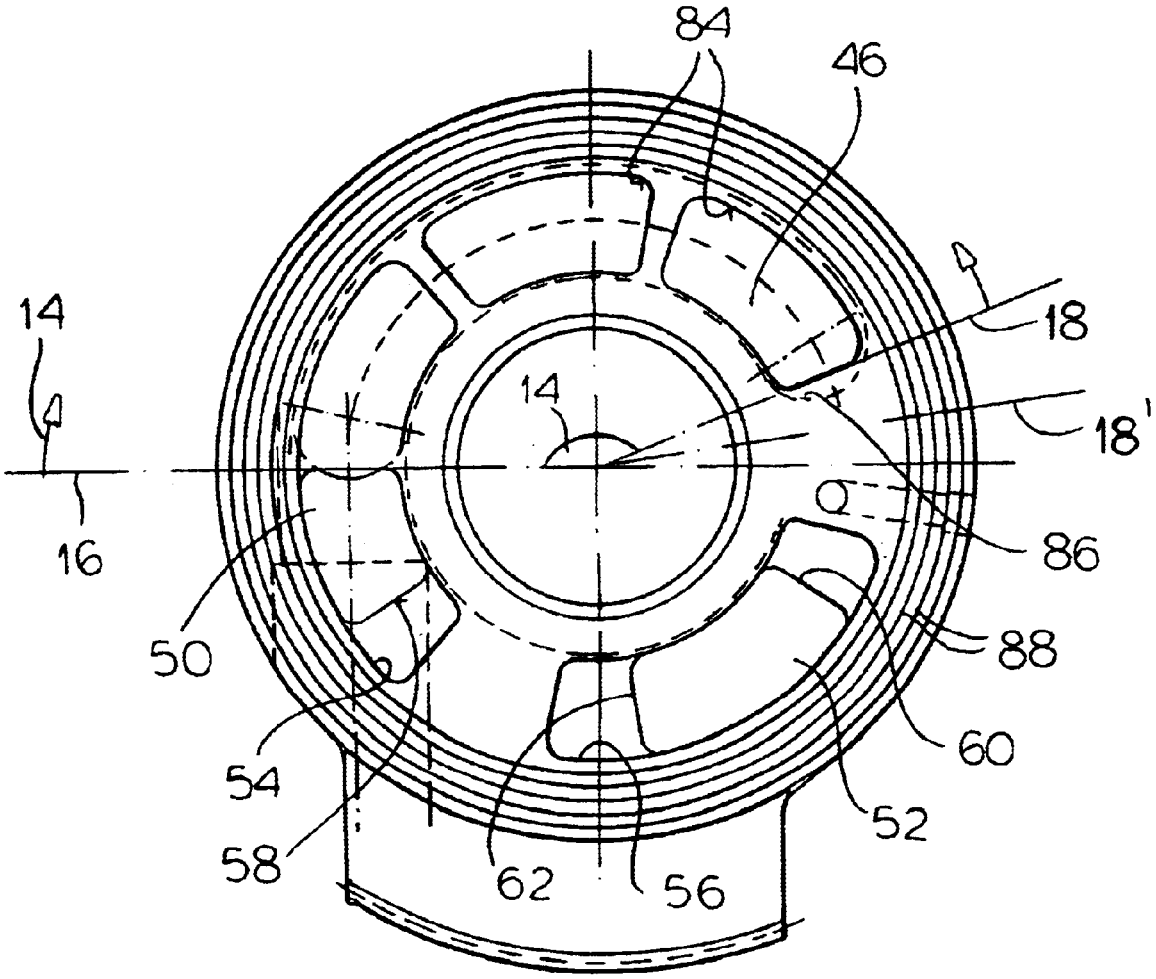
FIG. 6 is a plan view of the setting element in the state in which it is mounted on the hub.

The projections 50, 52 engage in recesses 54, 56 in the setting device 44 (FIGS. 5, 6). Each one side 58, 60 of the projections 50, 52 forms an abutment element and limits the rotatability of the setting device 44 in the clockwise direction of FIG. 6. The other side 62 of the projection 52 forms an abutment for the rotation in the counterclockwise direction.

As can be deduced from FIG. 1, the setting device 44 is disk-shaped and has a flange segment 64 with which it extends in a central opening of the hub 38. Within the flange segment 64, a roller bearing 66 is provided which is journaled on a radially inward shoulder sleeve 68 rotationally fixed to the drive shaft 42 and which is rotationally fixed to the rotor disk 6 by screws 70.

The setting element 44 is disposed opposite the hub 38 in the axial direction so that it rests against the sealing surface 48 of the hub 38, whereby the projections 50, 52 of the hub 38 engage in the recesses 54, 56 of the setting element 44. Between the setting element 44 and the hub 38 an O-ring 72 of elastomeric material is provided relatively far outwardly. This O-ring effects a sealing action radially outwardly on the one half and on the other half generates a prestress and renders a relative rotation of the setting element 44 and the hub 38 more difficult. In this manner the play for the adjustment setting device 74 to be described in the setting element is quasi abolished.

This setting device is described as a whole by the reference character 74 and encompasses a radially projecting region 76 of the setting element 44 and on which a gear toothing 78 is provided for engagement with measuring pinion 80 of an electric motor drive 82. It can also be seen from FIG. 1 that the electric motor drive 82 and the hub 38 are mounted on a machine frame 83 which is stationary in operation.

The suction application via the suction openings 12 of the contact region of each respective gripper arm 8 is effected via the suction delivery chamber 46 connected by a suction duct 47 with a device for producing the underpressure. From chamber 46 the suction is applied from the underpressure supply passage 47 via control openings 84 in the setting element 44 to the respective openings 32 in the rotor disk 6 and to the duct 34 to the suction openings 12. This occurs in a circular segment region 14 by rotation of the setting element 44 so that the control opening 84 in the setting element 44 and the respective mouth opening 32 in the rotor disk 6 overlap one another. As is apparent from FIG. 6 (in which however the rotor disk 6 has been omitted) this circular segment region 14 begins at the first angular position 16. As soon as the opening 32 of the rotor disk 6 has passed this angular position 16 suction is applied to the associated suction openings 12 of the respective gripper arm 8. This suction communication remains until the mouth opening 32 has been completely passed to the second angular position 18. By rotation of the setting element 44 in the counterclockwise direction of FIG. 6, the control opening 84 can overlap the illustrated boundary 86 of the space 46 and in this manner achieve a lengthening or enlargement of the circular segment region 14 until the side 60 of the projection 52 is engaged as a stop element in the setting element 44. In any case, the second angular position 18 can be advanced to the indicated position 18'. By rotation of the setting element 44 in the counterclockwise direction, the control opening 84 effects a shortening of the circular segment over which suction can be communicated to the arms.

When the delivery device is so mounted on the machine frame 83 (which also can be achieved by a preadjustment) that underpressure preferably is applied to the suction region 12 when the gripper arm 8 swings through the displacement plane of the web segment, the point in time or the position of the gripper arm 8 can be established at which the underpressure application ends. This can be set by an electric motor adjustment of the setting element 44 in the desired manner as a function of the surface characteristics of the web segments to be handled.

To keep the friction loss as low as possible, the rotor disk 6 to and the setting element 44 have the smallest possible axial spacing from one another. This can be achieved by matching the radial ball bearing 66 and conventional setting means. So that at the same time a sufficient seal is achieved, on the sealing element 44 and the rotor disk 6, labyrinth-like mutually interdigitating ring segment sections 88 are provided.

As can be seen from FIGS. 5 and 6, a section 90, which has superatmospheric pressure overpressure applied thereto is provided in the setting element 44 and is arranged after the peripheral boundary of the control opening 84 in the direction of rotation of the rotor. This section encompasses a radial opening 92 to which a compressed air fitting not shown is connectable and an axial opening 94 which is overlapped by a respective opening 32 of the rotor 4 at the instant of overlapping, the mouth opening 32 and the passages 34 to the suction region 12 of the respective gripper arm are subjected to air pressure which ensures a reliable release of a web segment.

What is claimed is:

1. A delivery device for taking up and delivering film web sections, comprising:

a stationary hub surrounding an axis, formed with a suction chamber communicating with a suction source and opening axially along a face of said hub at least one circular arc segment;

a rotor rotatable about said axis on a side of said hub provided with said face and having a plurality of arms for picking up respective film web sections by suction and releasing said film web sections, said rotor having respective openings along a face of said rotor spaced from said face of said hub for delivering suction to said arms in succession as said rotor rotates around said axis;

a disk-shaped setting element disposed between said faces and limitedly rotatable relative to said hub, said disk-shaped setting element having at least one control opening extending arcuately around said axis and communicating with said circular arc segment and with said openings for selectively varying an effective arc length over which said circular arc segment delivers suction to said arms and a rotation angle over which the suction is delivered to said arms based upon angular displacement of said setting element relative to said hub; and at least one stop element for limiting angular displacement of said setting element relative to said hub, said face of said hub and a juxtaposed face of said setting element forming seal surfaces, said stop element being formed with a projection engaging in a recess of the setting element and projecting over the sealing surfaces.

2. The delivery device defined in claim 1 wherein said projection is formed as a sealing cam bounding said circular arc segment at which said suction chamber opens toward said setting element and engaging in a control opening of the setting element.

3. The delivery device defined in claim 1, further comprising a labyrinth seal between said face of said rotor and a juxtaposed face of said setting element.

4. A delivery device for taking up and delivering film web sections, comprising:

a stationary hub surrounding an axis, formed with a suction chamber communicating with a suction source and opening axially along a face of said hub at least one circular arc segment;

a rotor rotatable about said axis on a side of said hub provided with said face and having a plurality of arms for picking up respective film web sections by suction and releasing said film web sections, said rotor having respective openings along a face of said rotor spaced from said face of said hub for delivering suction to said arms in succession as said rotor rotates around said axis;

a disk-shaped setting element disposed between said faces and limitedly rotatable relative to said hub, said disk-shaped setting element having at least one control opening extending arcuately around said axis and communicating with said circular arc segment and with said openings for selectively varying an effective arc length over which said circular arc segment delivers suction to said arms and a rotation angle over which the suction is delivered to said arms based upon angular displacement of said setting element relative to said hub; and the face of said hub and a juxtaposed face of said setting element forming sealing surfaces lying slidingly against one another, said setting element has an axially extending flange projecting through said hub, a drive train for said rotor extending through said flange.

5. A delivery device for taking up and delivering film web sections, comprising:

a stationary hub surrounding an axis, formed with a suction chamber communicating with a auction source and opening axially along a face of said hub at least one circular arc segment;

a rotor rotatable about said axis on a side of said hub provided with said face and having a plurality of arms for picking up respective film web sections by suction and releasing said film web sections, said rotor having respective openings along a face of said rotor spaced from said face of said hub for delivering suction to said arms in succession as said rotor rotates around said axis;

a disk-shaped setting element disposed between said faces and limitedly rotatable relative to said hub, said disk-shaped setting element having at least one control opening extending arcuately around said axis and communicating with said circular arc segment and with said openings for selectively varying an effective arc length over which said circular arc segment delivers suction to said arms and a rotation angle over which the suction is delivered to said arm based upon angular displacement of said setting element relative to said hub; and a pressurized section in said setting element communicating with said openings following the delivery of suction to said arms for pressurizing said arms with compressed air.

6. A delivery device for taking up and delivering film web sections, comprising:

a stationary hub surrounding an axis, formed with a suction chamber communicating with a suction source and opening axially along a face of said hub at least one circular arc segment;

a rotor rotatable about said axis on a side of said hub provided with said face and having a plurality of arms for picking up respective film web sections by suction and releasing said film web sections, said rotor having respective openings along a face of said rotor spaced from said face of said hub for delivering suction to said arms in succession as said rotor rotates around said axis; and a disk-shaped setting element disposed between said faces and limitedly rotatable relative to said hub, said disk-shaped setting element having at least one control opening extending arcuately around said axis and communicating with said circular arc segment and with said openings for selectively varying an effective arc length over which said circular arc segment delivers suction to said arms and a rotation angle over which the suction is delivered to said arms based upon angular displacement of said setting element relative to said hub, said setting element being provided with a pneumatic or hydraulic motor for displacing same.

7. The delivery device defined in claim 6 wherein said setting element is provided with teeth on an outer periphery thereof for coupling to said motor.

* * * * *